US007462060B2

(12) United States Patent
Hamoignon

(10) Patent No.: US 7,462,060 B2
(45) Date of Patent: Dec. 9, 2008

(54) CABLE CONNECTOR

(75) Inventor: Maurice Hamoignon, Habsheim (FR)

(73) Assignee: Woertz AG, Muttenz (CH)

( * ) Notice: Subject to any disclaimer, the term of this patent is extended or adjusted under 35 U.S.C. 154(b) by 0 days.

(21) Appl. No.: 10/534,701

(22) PCT Filed: Dec. 15, 2003

(86) PCT No.: PCT/CH03/00819

§ 371 (c)(1),
(2), (4) Date: Jun. 3, 2005

(87) PCT Pub. No.: WO2005/057729

PCT Pub. Date: Jun. 23, 2005

(65) Prior Publication Data

US 2006/0030185 A1 Feb. 9, 2006

(51) Int. Cl.
*H01R 4/24* (2006.01)

(52) U.S. Cl. ..... 439/409; 439/410; 439/157; 439/372

(58) Field of Classification Search ..... 439/409–410, 439/430, 402, 157, 372
See application file for complete search history.

(56) References Cited

U.S. PATENT DOCUMENTS

| | | | | | |
|---|---|---|---|---|---|
| 4,555,158 | A * | 11/1985 | Lam | ..... | 439/404 |
| 5,195,907 | A | 3/1993 | Urban | | |
| 5,934,930 | A * | 8/1999 | Camps et al. | ..... | 439/425 |
| 5,961,341 | A * | 10/1999 | Knowles et al. | ..... | 439/403 |
| 6,074,238 | A * | 6/2000 | DeRoss et al. | ..... | 439/409 |
| 6,364,695 | B1 | 4/2002 | Watanabe | | |
| 6,683,789 | B1 * | 1/2004 | Sheynis et al. | ..... | 361/752 |
| 2004/0235335 | A1 * | 11/2004 | Schoeffel et al. | ..... | 439/410 |

FOREIGN PATENT DOCUMENTS

GB 2 241 841 A 9/1991

* cited by examiner

*Primary Examiner*—Truc T Nguyen
*Assistant Examiner*—Xuong M Chung-Trans
(74) *Attorney, Agent, or Firm*—Breiner & Breiner, LLC

(57) ABSTRACT

A closing lever is provided for housing-shaped cable connectors having an upper and a lower component on one of the housing components. This closing lever operates to close both housing components in conjunction with a cam on the other housing component. This configuration ensures reliable closing without special exertion of force for the purpose of virtually automatically connecting two cables to each other.

4 Claims, 2 Drawing Sheets

9
1
3
3'
6''
6
6''
1'
6
10
11
6''
4
4'
2

CABLE CONNECTOR

FIELD OF INVENTION

The present invention relates to a cable connector in the form of a housing made up of at least two components which may be moved to come into contact with each other about an axis of rotation for electrically conducting connection of a flat cable having a plurality of conductors in the form of bunched conductors with at least one round cable also having a plurality of conductors in the form of bunched conductors, with a housing upper component for reception of the bared conductors of the round cable with the insulation removed, laterally separated from each other in the connection section provided inside the upper component of the housing, and having a housing lower component for reception of the flat cable, and with electrically conducting contacting elements on which the conductors of the round cable may be connected and which are provided with cutting tips for perforation of the conductor insulating materials and embedding in the strands of the conductors of the flat cable.

BACKGROUND OF INVENTION

One such cable connector, in which the multiple-conductor cables to be connected to each other preferably are configured as flat cables on one side and as round cables on the other, has been described in PCT Application WO 03/021721.

In this disclosed cable connector the contacting elements are contained in an intermediate component forming a part of the housing upper component. The contacting elements have cutting tips extending both downward and upward, so that connection of the two cables is effected automatically by compression of the housing components. Relatively high force must be applied in order to carry out the closing process with the required degree of certainty, regardless of whether the cutting tips of the contacting elements are to be pressed into both cables or into only one of them.

OBJECTS AND SUMMARY OF INVENTION

The object of this invention accordingly is to eliminate this disadvantage and provide means making it possible to close the cable connector in a simple and cost-effective manner.

It is claimed for the invention that this object is attained with a cable connector as defined in the foregoing having the characteristics specified in claim 1.

Specific embodiments of the cable connector claimed for the invention are defined in the dependent claims.

BRIEF DESCRIPTION OF DRAWING

The invention will be described in greater detail on the basis of exemplary embodiments illustrated in the drawing, in which.

DETAILED DESCRIPTION OF THE INVENTION

Figure 1:
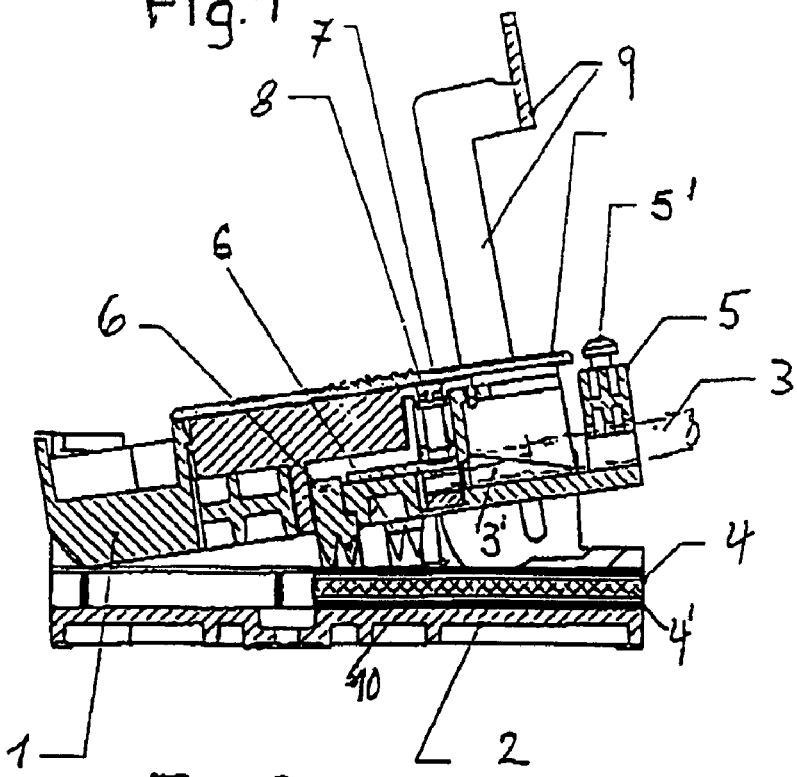
FIG. 1 presents a section in the form of a diagram through a cable connector claimed for the invention.
Figure 2:
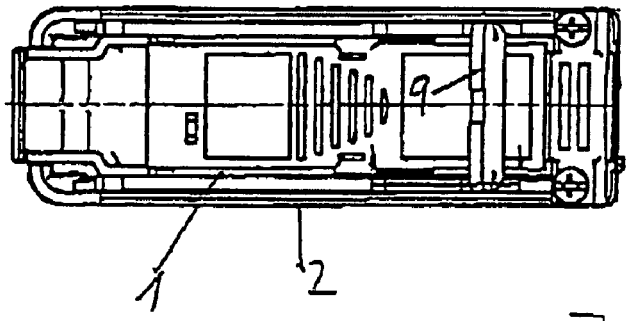
FIG. 2 a top view of the cable connector shown in FIG. 1.
Figure 3:
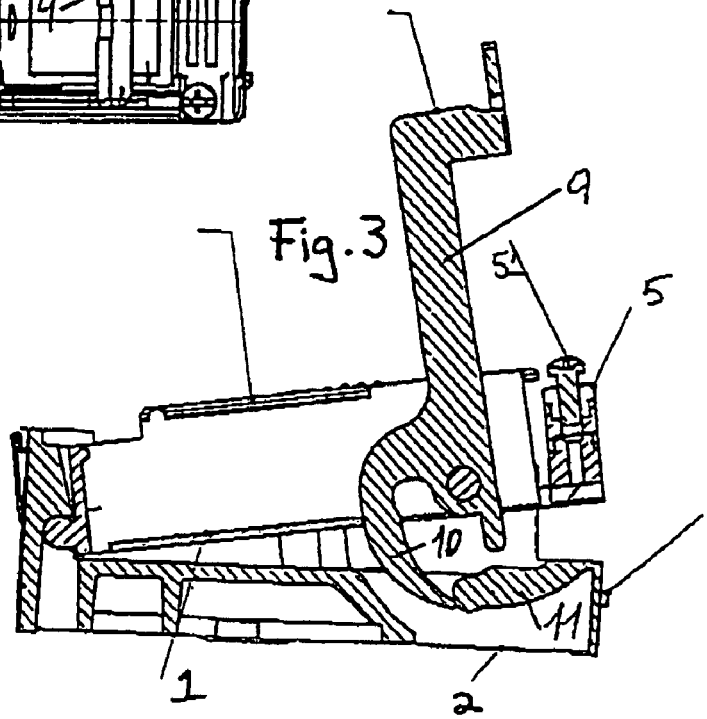
FIG. 3 another view of the cable connector shown in FIG. 1, with a side of the U-shaped closing lever shown in detail.

The housing-shaped cable connector shown in FIGS. 1 to 3 has a housing upper component 1 and housing lower component 2 which may be moved relative to each other about an axis of rotation positioned on the left side. The cable connector performs the function of connecting in a simple manner the conductors of a round cable 3 to the conductors of a flat cable 4.

The individual bared conductors 3' of the round cable 3, which is held at the entrance to housing upper component 1 by means of shackle 5, 5', are connected to conducting contacting elements 6 (by means of clamps 7 and screws 8).

The contacting elements 6 associated with the individual conductors 3' have cutting tips 6' pointing downward which, when the two housing components 1, 2 are moved together, automatically penetrate the insulations and are embedded in the bunched conductors 4' of the flat cable 4 and establish the electric connection desired.

In order that the forces required for moving the housing components completely together may be applied, a closing lever 9 is coupled to the housing upper component 1 as the core of this invention. The lever 9 is configured to be U-shaped and each side of the U is coupled to a side of the housing upper component 1.

Each side of the U is provided with a closing claw 10 which acts in conjunction with an associated cam 11 on opposite sides of housing lower component 2 so that when the lever 9 is thrown, the two housing components are pressed (and retained) against each other and the cutting tips 6' are pressed into the bunched conductors 4' of the flat cable 4 without special application of force.

Figure 4:
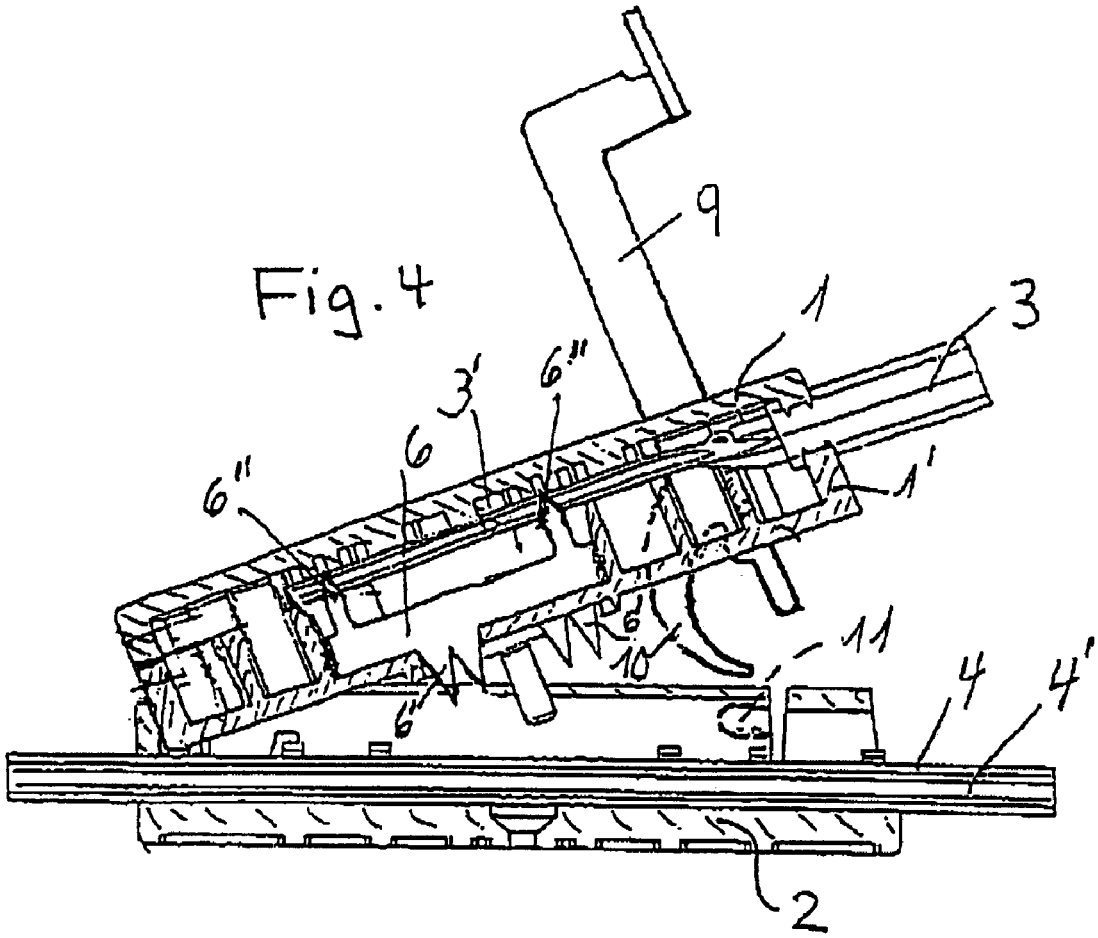
FIG. 4 a diagram of a section through an alternative embodiment of a cable connector claimed for the invention.

FIG. 4 of the drawing presents a diagram of an alternative embodiment of the cable connector claimed for the invention. The substantial difference is represented by the circumstance that there is associated with the housing upper component 1 an additional intermediate component 1' which performs the function of retaining the contacting elements 6. The latter have cutting tips 6' and 6" projecting both downward and upward.

The individual bared conductors 3' of the round cable 3, are engaged by the upper cutting tips 6" without baring of the individual conductors 3' when the connector is closed and electric connection is thereby established (as is the case with the lower cutting tips 6', which penetrate the bunched conductors 4' of the flat cable). The closing lever 9 essential for the invention is provided in this instance as well for closing the cable connector.

It is claimed:

1. A cable connector comprising a housing made up of at least two components including a first component and a second component which are movable angularly about an axis of rotation with respect to each other so as to come into contact with each other and simultaneously provide for electrically conducting connection, when present therein, of a flat cable having a plurality of bunched conductors with at least one round cable composed of a plurality of bunched conductors, wherein said first component is adapted to receive conductors of the at least one round cable with insulation thereon removed to provide bared conductors laterally separated from each other in a connection section provided inside the first component, and said second component is adapted to receive the flat cable, wherein electrically conducting contacting elements to which the conductors of the round cable connect and which include cutting tips for perforating insulation of the conductors and embedding in strands of the conductors of the flat cable, and a closing lever coupled at a distance from the axis of rotation with the first component, said closing lever having a first end and a second end, said second end being arranged partially inside said first component and including a closing claw which is engagable with a stationary cam on the second component in such a way that the at least first component and second component move in a direction of closing to contact each other for reciprocal closing when the closing lever is actuated by action on said first end and to press the cutting tips into the conductors of the flat cable thereby connecting the flat cable and the round cable together upon actuation of the closing lever.

2. The cable connector as claimed in claim 1, wherein the first component comprises a cover component and an intermediate component positioned below the cover component for receiving conductors of the round cable which are not bared and which are to be connected, wherein the contacting elements have cutting tips, which extend upward and downward for penetrating strands of the round cable and the flat cable, are mounted and retained in the intermediate component such that the cutting tips project from two surfaces of the intermediate component opposite the cover component such that when sandwich-like assembly of the cover component, the intermediate component, and the second component is provided by the closing lever moving the first component and the second component into contact with each other, electric connection is automatically established between said cover component, said intermediate component and the second component.

3. A cable connector comprising a housing made up of at least two components including a first component and a second component which are movable angularly about an axis of rotation with respect to each other so as to come into contact with each other and simultaneously provide for electrically conducting connection, when present therein, of a flat cable having a plurality of bunched conductors with at least one round cable composed of a plurality of bunched conductors, wherein said first component is adapted to receive conductors of the at least one round cable with insulation thereon removed to provide bared conductors laterally separated from each other in a connection section provided inside the first component, and said second component is adapted to receive the flat cable, wherein electrically conducting contacting elements to which the conductors of the round cable connect and which include cutting tips for perforating insulation of the conductors and embedding in strands of the conductors of the flat cable, and a closing lever coupled at a distance from the axis of rotation with the first component, said closing lever having a first end and a second end, said second end being arranged partially inside said first component and including a closing claw which is engagable with a stationary cam on the second component in such a way that the at least first component and second component move in a direction of closing to contact each other for reciprocal closing when the closing lever is actuated by action on said first end and to press the cutting tips into the conductors of the flat cable thereby connecting the flat cable and the round cable together upon actuation of the closing lever, wherein the closing lever has a U-shaped configuration and sides of the closing lever are coupled to one of the at least two components and each side includes a closing claw which operates in conjunction with an associated one of said stationary cam.

4. The cable connector as claimed in claim 3, wherein the first component comprises a cover component and an intermediate component positioned below the cover component for receiving conductors of the round cable which are not bared and which are to be connected, wherein the contacting elements have cutting tips, which extend upward and downward for penetrating strands of the round cable and the flat cable, are mounted and retained in the intermediate component such that the cutting tips project from two surfaces of the intermediate component opposite the cover component such that when sandwich-like assembly of the cover component, the intermediate component, and the second component is provided by the closing lever moving the first component and the second component into contact with each other, electric connection is automatically established between said cover component, said intermediate component and the second component.

* * * * *